US006543362B1

(12) United States Patent
Muskat

(10) Patent No.: US 6,543,362 B1
(45) Date of Patent: Apr. 8, 2003

(54) MULTI-POINT IGNITION SYSTEM FOR HIGH-PERFORMANCE PROPULSION SYSTEMS, IN PARTICULAR FOR AMMUNITION

(75) Inventor: Erich Muskat, Roth (DE)

(73) Assignee: Dynamit Nobel GmbH Explosivstoff-und Systemtechnik, Troisdorf (DE)

( * ) Notice: Subject to any disclaimer, the term of this patent is extended or adjusted under 35 U.S.C. 154(b) by 96 days.

(21) Appl. No.: 09/714,950

(22) Filed: Nov. 20, 2000

(30) Foreign Application Priority Data

Nov. 19, 1999 (DE) ..... 199 55 945
May 18, 2000 (DE) ..... 100 24 464

(51) Int. Cl.[7] ..... F42C 19/08

(52) U.S. Cl. ..... 102/202; 102/470; 102/217; 102/352

(58) Field of Search ..... 102/202, 430–433, 102/470, 217, 320, 345, 332, 360, 380; 60/253, 256

(56) References Cited

U.S. PATENT DOCUMENTS 4,777,881 A * 10/1988 Candland et al. ..... 102/430
4,823,701 A * 4/1989 Wilhelm ..... 102/200
5,071,496 A * 12/1991 Coursen et al. ..... 102/313
5,263,416 A * 11/1993 Amundson et al. ..... 102/202.7
5,705,766 A * 1/1998 Farace et al. ..... 102/202
5,894,103 A * 4/1999 Shann ..... 102/215
6,334,394 B1 * 1/2002 Zimmermann et al. ..... 102/202

FOREIGN PATENT DOCUMENTS

EP 526835 A1 * 2/1993

* cited by examiner

*Primary Examiner*—Peter M. Poon
*Assistant Examiner*—F. Copier
(74) *Attorney, Agent, or Firm*—Antonelli, Terry, Stout & Kraus, LLP

(57) ABSTRACT

A high-performance propulsion system includes propellant charge powder arranged in a case (1) and multiple pyrotechnic igniters (9) for igniting the propellant charge powder, each igniter (9) containing a primer (5) and optionally a booster charge (6).

13 Claims, 2 Drawing Sheets

MULTI-POINT IGNITION SYSTEM FOR HIGH-PERFORMANCE PROPULSION SYSTEMS, IN PARTICULAR FOR AMMUNITION

BACKGROUND OF THE INVENTION

The invention relates to a high-performance propulsion system having propellant charge powder arranged in a case and a pyrotechnic igniter for igniting the propellant charge powder, the igniter containing a primer and optionally a booster charge; and a method for igniting a high-performance propulsion system of this kind.

The ignition system used today for propellant charge powders in large-caliber ammunition functions predominantly by a pyrotechnic igniter that is housed axially in the rear end of the round. Following triggering by an electrical or mechanical pulse, reaction of the pyrotechnic ignition mixture occurs, and incandescent particles are introduced at high pressure into the bed of propellant powder, igniting the propellant charge. Because of the geometry of the propellant charge igniter, the ignition gases flow radially outward through holes in the metal jacket of the igniter. With a design of this kind, the particle flow also has an axial component. In most cases, however, the first part of the ignition process is limited to the rear portion of the powder bed because of the dimensions of the charge space of modern munitions.

This limitation can result in unfavorable internal ballistic conditions, and can cause destruction of the gun due to locally extreme pressure spikes.

SUMMARY OF THE INVENTION

The goal of the invention is to improve a high-performance propulsion system having propellant charge powder arranged in a case and a pyrotechnic igniter for igniting the propellant charge powder, the igniter containing a primer and optionally a booster charge, in such a way that internal ballistic conditions upon ignition are substantially improved, and even compact charge configurations with a high charge density can thereby be reliably ignited.

According to the present invention, this goal is achieved in that:

- multiple igniters are arranged in the case;
- all the igniters have a programmable electronic unit in which an individual address is stored;
- the igniters are connected via a two-conductor or multi-conductor bus line to an igniter element; and
- the igniter element can be connected to a fire-control computer.

As a result, the propellant charge powder can be ignited in controlled fashion at previously selectable points. The number and sequence in time of the ignition events is determined in such a way that, even under extreme environmental conditions, no unfavorable internal ballistic conditions (e.g. negative differential gas pressures) can occur.

In a preferred embodiment, a temperature sensor for measuring the temperature of the propellant charge powder is arranged in the igniter.

The ignition process is coordinated by the fire-control computer, which communicates with the individual igniters via the bus line, e.g. measures the temperature at the individual ignition points and then, based on a previously defined formula, decides as to the number, sequence in time, and physical distribution of the igniters or ignition points to be triggered.

Advantageously, retrievable features of the propellant charge powder are stored in the electronic unit.

The igniters are immovably joined to the inner side of the case, and in a preferred embodiment are embedded in webs extending on the inner side of the case.

The case is of either fully combustible, partially combustible, or incombustible configuration.

The bus line leads to a central ignition element which is preferably embedded in the end-surface closure cover of the case.

The ignition element contains an ignition distributor and a contact screw.

The high-performance propulsion system according to the invention is preferably used for tank-gun ammunition or artillery ammunition.

A method according to the present invention for igniting a high-performance propulsion system as described is characterized by one or more of the steps recited below:

- ascertaining the temperature of the propellant charge powder and forwarding it to the fire-control computer;
- reading out individual features of the propellant charge powder stored in electronic unit 10, and forwarding those data to the fire-control computer;
- determining, in the fire-control computer, the number and sequence in time of igniters 9 to be ignited, and programming those igniters 9;
- delivering an ignition pulse to igniters 9.

The invention is therefore characterized by the following features:

Located in the interior of the cartridge are multiple igniters that are immovably joined to the inner side of the cartridge case and ignite radially or at different angles into the powder bed.

The igniters can be embedded in multiple webs extending along the inner side of the cartridge, so as thereby to prevent any damage from propellant powder grains when the cartridge is jostled.

The cartridge case itself can be completely or partly combustible, or incombustible.

The ignition clusters are connected via a two-conductor or multi-conductor bus line to an ignition element.

Located in the igniter is an intelligent electronic unit that can be programmed by a fire-control computer. Each igniter furthermore contains a stored address and a temperature sensor. The temperature in the propellant charge powder bed can thereby be forwarded to the fire-control computer. Features of the propellant charge powder can also be stored in the igniter memory, for interrogation and correction of the fire-control computer.

By means of the bus line, the igniters can be individually addressed or programmed, e.g. as to whether or not they activate in response to the ignition pulse.

This multi-point ignition system is particularly suitable for high-performance propulsion systems, in particular for tank-gun ammunition and artillery ammunition.

With this multi-point ignition system, it is possible to ignite very compact charge configurations having a high charge density, through which a conventional propellant charge igniter can no longer penetrate.

BRIEF DESCRIPTION OF THE DRAWINGS

Further features of the invention are evident from the figures that are described below, in which.

DETAILED DESCRIPTION OF THE PREFERRED EMBODIMENTS

Figure 1A:
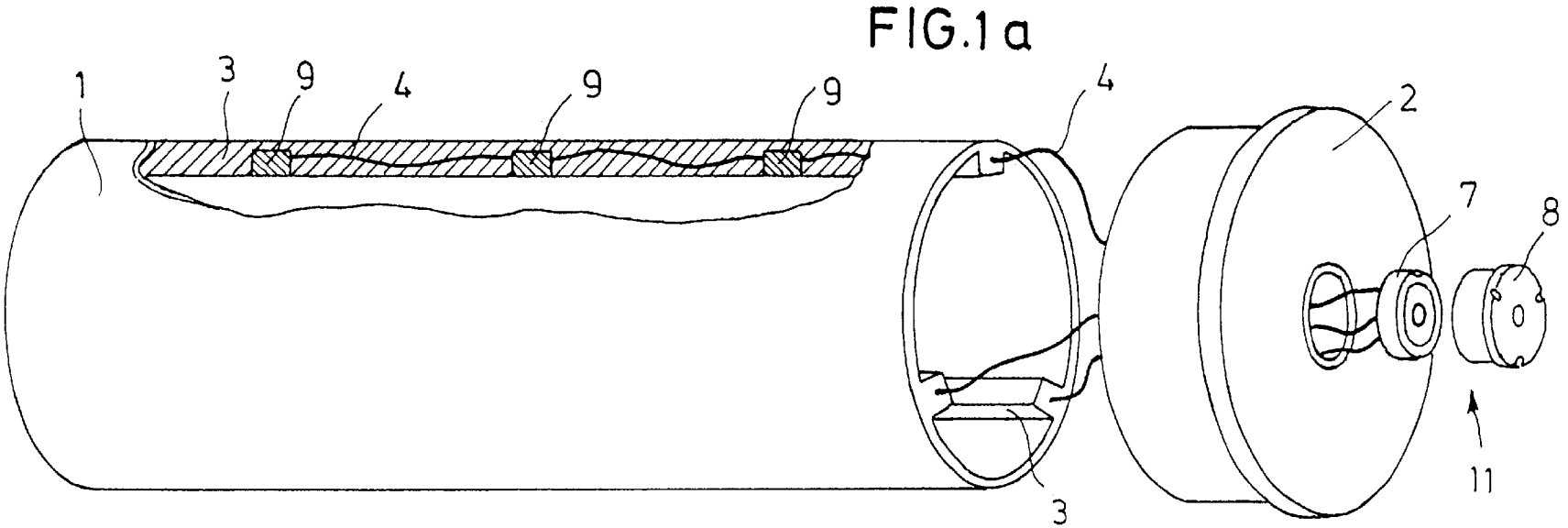
FIG. 1*a* schematically shows a cartridge case having a multipoint ignition system according to the present invention.

FIG. 1*a* shows schematically, in a perspective view, a cartridge case 1 having a closure cover 2. For improved clarity, closure cover 2 (also called the "stub case") is shown pulled off cartridge case 1.

Arranged on the inner side of cartridge case 1, distributed uniformly in the circumferential direction, are three webs 3 that extend in the longitudinal direction of cartridge case 1 over its entire length. During production of the cartridge, cartridge case 1 is completely filled with propellant charge powder, so that webs 3 project into the propellant charge powder. For reasons of clarity, the propellant charge powder is not shown in FIG. 1*a*. Individual igniters 9 for the propellant charge powder are embedded, in a row, into the webs.

Igniters 9 are interconnected via a single-conductor or multi-conductor bus line 4 that leads from the three webs 3 to an ignition element 11 in closure cap 2 of cartridge case 1. One bus line 4 is provided for each web 3. Ignition element 11 comprises an ignition distributor 7 and a contact screw 8. When the cartridge is to be fired, a contact element (not shown) that is electrically connected to a fire-control computer (not shown) is placed on ignition element 11. The fire-control computer is thereby connected to the individual igniters 9 and can read data in and out.

Figure 1B:
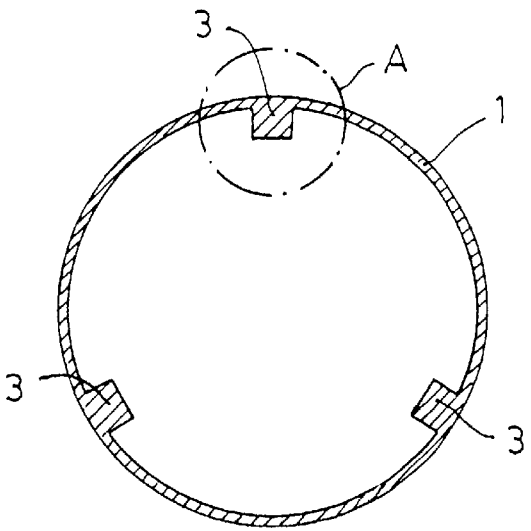
FIG. 1*b* shows a section through the cartridge case shown in FIG. 1*a;*

FIG. 1*b* shows a section transversely through cartridge case 1 shown in FIG. 1*a*. The three webs, which are arranged at an offset of 120° from one another and in which igniters 9 are embedded, are clearly evident.

Figure 1C:
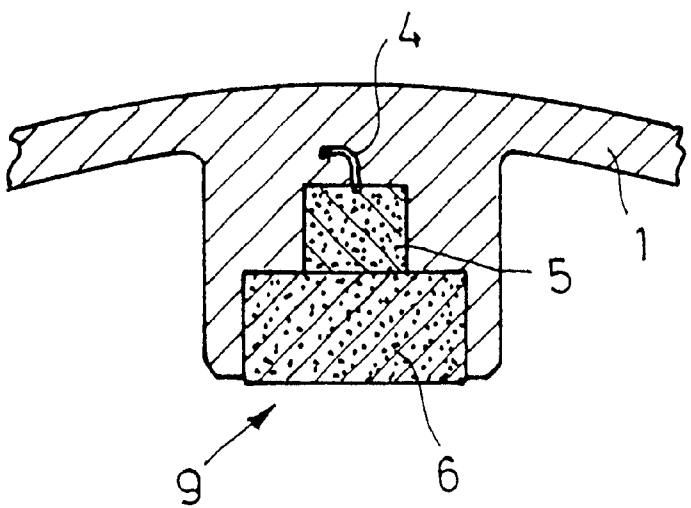
FIG. 1*c* shows portion A of FIG. 1*b,* depicted in enlarged fashion.

FIG. 1*c* shows portion A of FIG. 1*b* depicted in enlarged fashion, with igniters 9 shown schematically. An igniter 9 comprises a primer 5 and optionally a booster charge 6. Reference numeral 4 indicates the bus line. The electronic unit is not shown.

Figure 2:
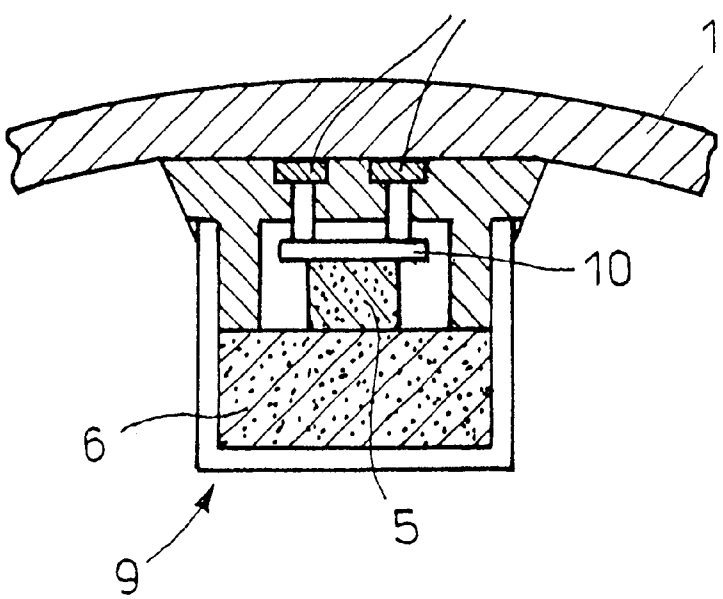
FIG. 2 shows a portion similar to FIG. 1*c,* with individual details.

FIG. 2 shows a portion similar to FIG. 1*c,* but with individual details.

According to the present invention, an electronic unit 10, for example a chip having an integrated circuit or a circuit board having electronic components, is arranged in each igniter 9. Bus line 4 is connected to said electronic unit 10. Arranged on or in said unit 10 is an ignition element which, upon ignition, ignites primer 5, which in turn ignites booster charge 6. The ignition gases thereby generated then ignite the propellant charge powder.

Not shown is the fact that a temperature sensor is arranged in electronic unit 10, or a temperature sensor is connected to unit 10. Also not shown is the fact that features of the propellant charge powder can be stored in unit 10.

Before ignition, the fire-control computer checks the temperature at the ignition points and determines therefrom which igniters 9 are or are not to be ignited. The fire-control computer then programs igniters 9, or the individual electronic units 10, accordingly. When an ignition pulse is emitted upon ignition, only the desired igniters 9 are then ignited.

What is claimed is:

1. High-performance propulsion system, comprising:

a case;

propellant charge powder arranged in the case;

a plurality of pyrotechnic igniters arranged in the case for igniting the propellant charge powder, each of the pyrotechnic igniters including a primer and a programmable electronic unit in which an individual address is stored;

an igniter element connectable to a fire control computer; and at least one two-conductor or multi-conductor bus line connecting the plurality of pyrotechnic igniters to the igniter element.

2. High-performance propulsion system as defined in claim 1, characterized in that a temperature sensor for measuring the temperature of the propellant charge powder is arranged in the plurality of pyrotechnic igniters.

3. High-performance propulsion system as defined in claim 1, characterized in that properties of the propellant charge powder are stored in the electronic unit.

4. High-performance propulsion system as defined in claim 1, characterized in that the plurality of pyrotechnic igniters are immovably joined to an inner side of the case.

5. High-performance propulsion system as defined in claim 1, characterized in that the plurality of pyrotechnic igniters are embedded in webs extending on an inner side of the case.

6. High-performance propulsion system as defined in claim 1, characterized in that the case is fully combustible.

7. High-performance propulsion system as defined in claim 1, characterized in that the igniter element is embedded in an end-surface closure cover of the case.

8. High-performance propulsion system as defined in claim 1, characterized in that the igniter element contains an ignition distributor and a contact screw.

9. High-performance propulsion system as defined in claim 1, characterized in that the high-performance propulsion system is used for tank-gun ammunition or artillery ammunition.

10. A method for igniting a high-performance propulsion system, comprising a case, propellant charge powder arranged in the case, a plurality of of the pyrotechnic igniters including a primer and a programmable electronic unit in which an individual address is stored; an igniter element connectable to a first control computer; and at least one two-conductor of multi-conductor bus line connecting the plurality of pyrotechnic igniters to the igniter element, the method comprising:

ascertaining the temperature of the propellant charge powder and forwarding it to the fire-control computer;

reading properties of the propellant charge powder stored in the electronic unit, and forwarding those data to the fire-control computer;

determining, in the fire-control computer, the number and sequence in time of the pyrotechnic igniters to be ignited, and programming those pyrotechnic igniters;

delivering an ignition pulse to the pyrotechnic igniters.

11. High-Performance propulsion system as defined in claim 1, characterized in that each of the pyrotechnic igniters further comprises a booster charge.

12. High-performance propulsion system as defined in claim 1, characterized in that the case is partially combustible.

13. High-performance propulsion system as defined in claim 1, characterized in that the case is incombustible.

* * * * *